US010500468B1

(12) United States Patent
Currier

(10) Patent No.: US 10,500,468 B1
(45) Date of Patent: Dec. 10, 2019

(54) GOLF TRAINING AID SIMULATING A GRASS CUTTING MOTION

(71) Applicant: Edward A. Currier, Palm Harbor, FL (US)

(72) Inventor: Edward A. Currier, Palm Harbor, FL (US)

( * ) Notice: Subject to any disclaimer, the term of this patent is extended or adjusted under 35 U.S.C. 154(b) by 0 days.

(21) Appl. No.: 16/105,503

(22) Filed: Aug. 20, 2018

Related U.S. Application Data

(63) Continuation-in-part of application No. 15/787,506, filed on Oct. 18, 2017, now abandoned.

(60) Provisional application No. 62/409,777, filed on Oct. 18, 2016.

(51) Int. Cl.
*A63B 53/04* (2015.01)
*A63B 69/36* (2006.01)

(52) U.S. Cl.
CPC ..... *A63B 69/3623* (2013.01); *A63B 69/3676* (2013.01); *A63B 2069/3629* (2013.01)

(58) Field of Classification Search
USPC ..... 473/313, 314, 244–248, 307
See application file for complete search history.

(56) References Cited

U.S. PATENT DOCUMENTS 205,879 A * 7/1878 Lester
786,268 A * 4/1905 Cory
800,872 A * 10/1905 Newcomb
1,068,346 A * 7/1913 Kilborn ..... A01B 1/20 172/375
1,259,944 A * 3/1918 Welch ..... A01B 1/08 172/371
1,334,189 A * 3/1920 Swanson ..... A63B 53/04 473/306
1,367,380 A * 2/1921 Haas ..... A01D 1/06 30/318
1,574,915 A * 3/1926 Marston ..... A63B 53/0487 473/252
2,431,106 A * 11/1947 Brooke ..... A01D 1/06 30/318
3,210,111 A * 10/1965 Fallon ..... A63B 57/50 15/160
D222,678 S * 11/1971 Dick ..... 473/325
3,942,591 A * 3/1976 Brannin ..... A01B 1/08 172/371
4,674,746 A * 6/1987 Benoit ..... A63B 60/24 30/308.1

(Continued)

*Primary Examiner* — Nini F Legesse
(74) *Attorney, Agent, or Firm* — Paul Murty; Smith & Hopen, P.A.

(57) ABSTRACT

A golf training aid simulating a grass whip consists of a club shaft, a neck portion, and a blade portion. The blade portion is connected to the club shaft via the neck portion. The club shaft replicates the shaft of a golf club. The blade portion replicates the club head of a golf club. The weight for the blade portion is specifically selected so that the wrists of the user adjusts along with the swing. Moreover, the shape of the blade portion is specifically shaped to minimize air resistance. The shape of the blade portion also helps the blade portion to smoothly cut through grass. Since the apparatus helps the user practice on striking grass during a swing, when a golf club is used with a golf ball, the user can accurately strike the ball at an optimal contact point.

7 Claims, 6 Drawing Sheets

(56) References Cited

U.S. PATENT DOCUMENTS 5,090,703 A * 2/1992 Koumarianos ..... A63B 53/04 473/328
5,116,054 A * 5/1992 Johnson ..... A63B 53/0487 473/240
5,255,919 A * 10/1993 Johnson ..... A63B 53/0487 473/313
5,569,098 A * 10/1996 Klein ..... A63B 53/007 473/300
5,609,531 A * 3/1997 Gates ..... A63B 69/3632 473/256
6,095,929 A * 8/2000 Clark ..... A63B 60/00 473/248
6,264,571 B1 * 7/2001 Lekavich ..... A63B 53/02 473/340
6,517,445 B1 * 2/2003 O'Neill ..... A01B 1/16 172/378
6,929,560 B1 * 8/2005 Roshala ..... A63B 15/00 473/256
6,988,954 B1 * 1/2006 Buell ..... A01D 34/90 30/276
7,507,166 B2 * 3/2009 Jung ..... A63B 53/047 473/314
D640,515 S * 6/2011 Tanis ..... D8/11
8,672,771 B1 * 3/2014 Vlosich ..... A63B 53/04 473/251
9,061,187 B2 * 6/2015 Yount ..... A63B 53/065
10,143,121 B2 * 12/2018 Holdredge ..... A01B 1/08
2005/0070373 A1 * 3/2005 Johnson ..... A63B 53/02 473/340
2008/0207350 A1 * 8/2008 Jung ..... A63B 53/047 473/328
2009/0227387 A1 * 9/2009 Pontius ..... A63B 53/0487 473/236
2013/0203522 A1 * 8/2013 Franklin ..... A63B 53/007 473/341

* cited by examiner

GOLF TRAINING AID SIMULATING A GRASS CUTTING MOTION

CROSS-REFERENCE TO RELATED APPLICATIONS

This nonprovisional application is a continuation-in-part of and claims priority to nonprovisional application Ser. No. 15/787,506, entitled "Golf Training Aid Simulating a Grass Cutting Motion," filed Oct. 18, 2017 by the same inventor, which claims priority to provisional application No. 62/409,777, entitled "Golf Training Aid Simulating a Grass Cutting Motion," filed on Oct. 18, 2016 by the same inventor.

BACKGROUND OF THE INVENTION

1. Field of the Invention

This invention relates, generally, to golf training aids. More specifically, it relates to a golf swing training apparatus that utilizes a grass cutting motion. By utilizing the present invention, which is based upon natural body movements, the user can perfect a golf swing with greater efficiency.

2. Brief Description of the Prior Art

Golf is a sport enjoyed by individuals of all ages. Regardless of the level in which the sport is played, golf requires a significant amount of training. A general training process for golf would be mainly based upon improving muscle movement, coordination, muscular endurance, and balance. A majority of the available golf training programs and golf training aids have significant drawbacks that need to be addressed.

One significant drawback of existing programs is the lack of attention given to beginners. The athletic ability varies from one person to another. Thus, the muscle movements and muscle coordination related to a certain activity can also vary from one person to another. Most training programs have minimum regard to the differences among individuals. In such situations, the many instructions related with a training program can be overwhelming to a beginner. Therefore, for greater results, a training program that utilizes natural body movements of the user is clearly needed.

Another drawback is the lack of training aids that mimic the exact motion of a golf swing. As an example, golf training whips, that have a weighted end and a flexible body, are significantly different from a golf club. Thus, the user does not get the intended experience when training with these whips. Using grass whips is another successful training method. However, most of the grass whips are significantly different from a golf club. As an example, most of the grass whips are designed for one-handed operation. In other instances, the grass whips have a wooden grip which is significantly larger in diameter than a golf club. In addition, the center of mass of most grass whips is not concentrated toward the head of the grass whip, meaning that typical grass whips do not mimic the center of mass of a golf club. These differences in design significantly impact the ability of mastering the golf swing.

Accordingly, what is needed is a golf training aid that accurately simulates a golf swing motion by mimicking the design, weight, and center of mass of a golf club. In addition, what is needed is a golf training aid that provide real-time feedback of swing quality via a visual indicator of one or more leaves of grass being cut and flying away from a ground surface. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicant in no way disclaims these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a golf training aid that accurately simulates a golf swing motion by mimicking the design, weight, and center of mass of a golf club is now met by a new, useful, and nonobvious invention.

The novel structure includes a club shaft having a first end opposite a second end, with a club shaft body extending from the first end to the second end. An elongated blade portion is in mechanical communication with the second end of the club shaft. The blade portion includes a top surface opposite a bottom surface, with each of the top and bottom surfaces having an associated width that is parallel to a lateral axis of the blade portion. The width of the bottom surface is different from the width of the top surface, such that there is a first tapered edge opposite a second tapered edge, both tapered edges disposed between the top and bottom surfaces. The tapered edges have a taper angle between 30° and 60°. The blade portion also includes a height disposed between the top and bottom surfaces, with the height being parallel to a vertical axis of the blade portion. The height is smaller than a radius of a standard golf ball. The blade portion creates a visual indicator of a successful swing when one of the tapered edges cuts though one or more leaves of grass. The visual indicator is a change in position of the one or more leaves of grass, such as cutting and removing the grass from a ground surface.

The novel method of training to improve a golf swing includes the steps of gripping the first end of the golf training aid, and swinging that golf training aid such that the first tapered edge traverses through one or more leaves of grass. Because the golf training aid includes a pair of tapered edges oppositely disposed on the blade portion, the method can also include the step of swinging the training aid such that the second tapered edge cuts through one or more leaves of grass during a backswing.

An object of the invention is to provide a golf training aid that simulates a grass cutting motion. Compared to other available products, the present invention accurately mimics a golf club so that the golf swing can be accurately practiced via the grass cutting motion. Moreover, the grass cutting motion allows the user to master the golf swing with minimum guidance by providing a visual indicator, such as leaves of grass being removed from a ground surface via the golf training aid.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

The present invention includes a golf training aid that helps a user practice and master a golf swing. More specifically, the present invention helps the user develop skills such as muscle movement, balance, and coordination, which are essential to execute a proper golf swing. In doing so, the present invention is designed to simulate a grass whip motion, so that the user can develop the required skills through natural body movements.

Figure 1:
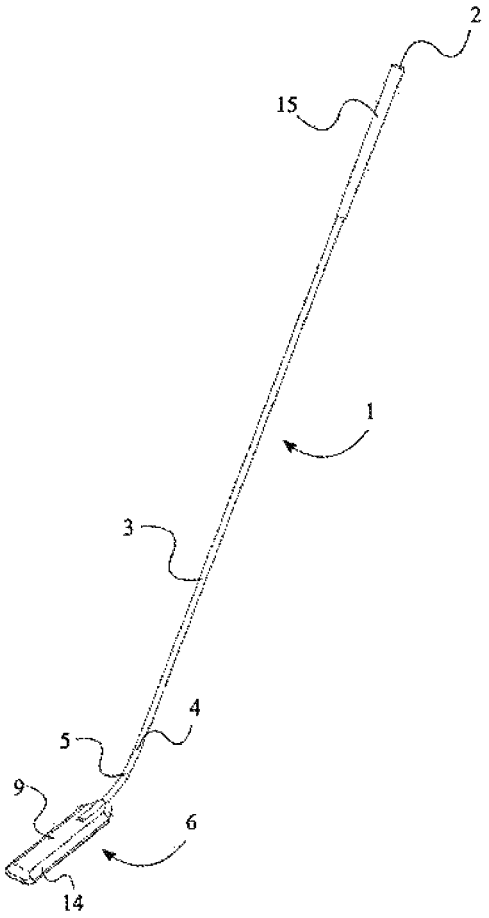
FIG. 1 is a perspective view of the present invention.
Figure 2:
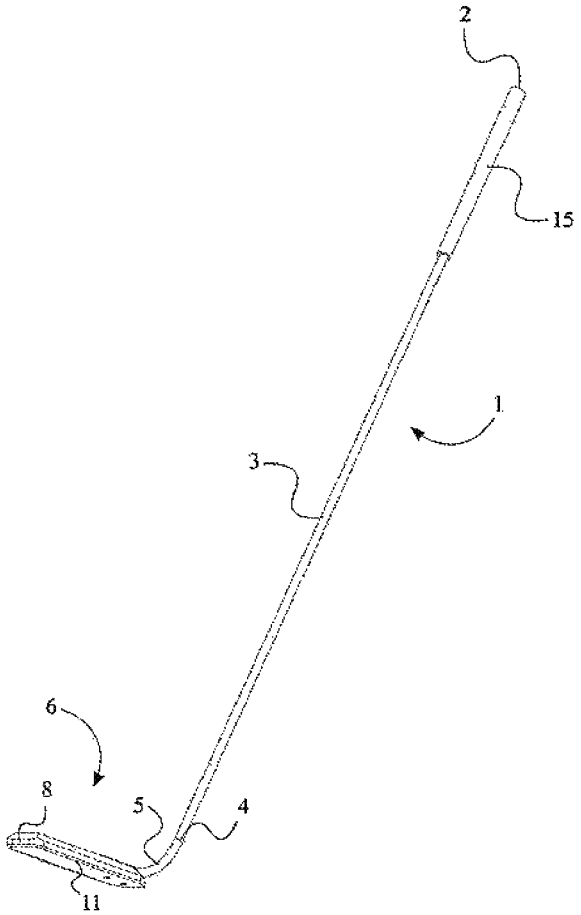
FIG. 2 is another perspective view of the present invention.

As illustrated in FIG. 1 and FIG. 2, to mimic the use of a golf club and allow the user to practice a swing used in golf, the present invention comprises a club shaft 1, a neck portion 5, and a blade portion 6. The club shaft 1, which is preferably made of graphite or other comparable material, is similar to a shaft of a golf club and comprises a first end 2, a club shaft body 3, and a second end 4. The club shaft body 3, which determines the overall length of the club shaft, extends from the first end 2 to the second end 4. The length of the club shaft body 3 can vary in different embodiments of the present invention. As an example, the club shaft body 3 can be short to cater to children utilizing the present invention. On the other hand, the club shaft body 3 can be long to cater to adults who intend on utilizing the present invention.

Figure 3:
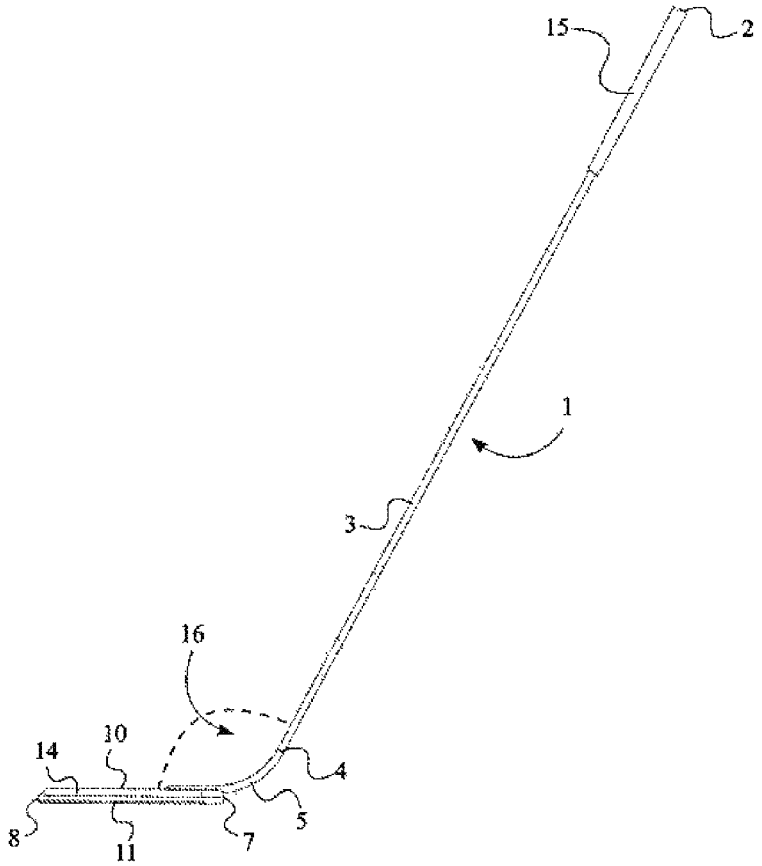
FIG. 3 is a side view of the present invention.
Figure 4:
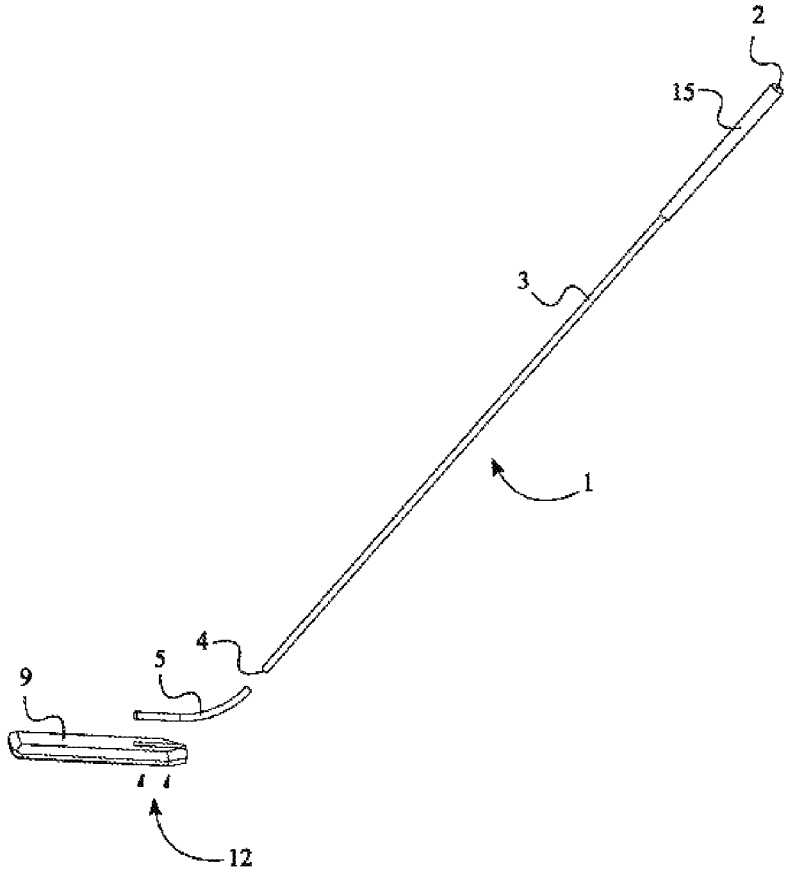
FIG. 4 is an exploded view of the present invention.

The neck portion 5 functions as a connector between the club shaft 1 and the blade portion 6, so that the blade portion 6 can be positioned at a preferred lie angle, which is an angle between the club shaft 1 and a ground. To do so, the neck portion 5 is terminally connected at the second end 4. On the other hand, the blade portion 6 is connected to the neck portion 5 opposite the club shaft 1. As shown in FIG. 3, in the final configuration, the blade portion 6 is oriented at an obtuse angle 16 from the club shaft 1, so that the preferred lie angle is achieved. In addition, as shown in FIG. 4, the present invention further comprises an attachment mechanism 12 to connect the neck portion 5 to the blade portion 6. The attachment mechanism 12 can vary in different embodiments of the present invention. As an example, in one embodiment of the present invention the neck portion 5 can be welded to the blade portion 6. However, in the preferred embodiment of the present invention, the neck portion 5 is connected to the blade portion 6 via a plurality of screws.

Turning again to FIGS. 1 and 2 in detail, the blade portion 6 represents a club head of a golf club. In general, the club head is designed such that the weight of the golf club is concentrated towards the club head. Said another way, the center of mass of the golf club is disposed on the club shaft and adjacent to the club head, due to the weight of the club head compared with the club shaft. When a golfer swings a golf club, the golfer must rotate the club head on the downswing such that the club head faces the golf ball, thereby ensuring a clean contact with the golf ball. If the golfer rotates the club head too early or too late, the club head will not make a clean (or "square") contact with the golf ball, and the ball will either hook (to the left of the desired location) or slice (to the right of the desired location). The center of mass of a golf club is an important factor in determining the proper swing angle, because the golfer must rotate his or her wrists, and thereby rotate the club head, at a particular time to ensure a clean contact with the golf ball. If the golfer practices with a training aid that does not properly mimic the center of mass of a typical golf club, then the golfer will likely rotate his or her wrists at an incorrect time, leading to a poor swing and a poor contact with the golf club. Accordingly, it is essential that an effective golf swing training aid accurately mimics the center of mass of a golf club.

To be similar to the club head in terms of weight distribution and center of mass, the blade portion 6 is specifically weighted so that the center of mass is concentrated at the blade portion 6 and the overall weight is similar to that of a standard golf club. In the preferred embodiment, the present invention has a weight similar to a 5-iron club. The weight of the present invention is especially important to practice the wrist movements that occur during a golf swing, as discussed in greater detail above. In other words, the weight of the blade portion 6, and the center of mass of the present invention, force the wrists of the user to mimic a position and rotation of the wrists during a golf swing.

Figure 5:
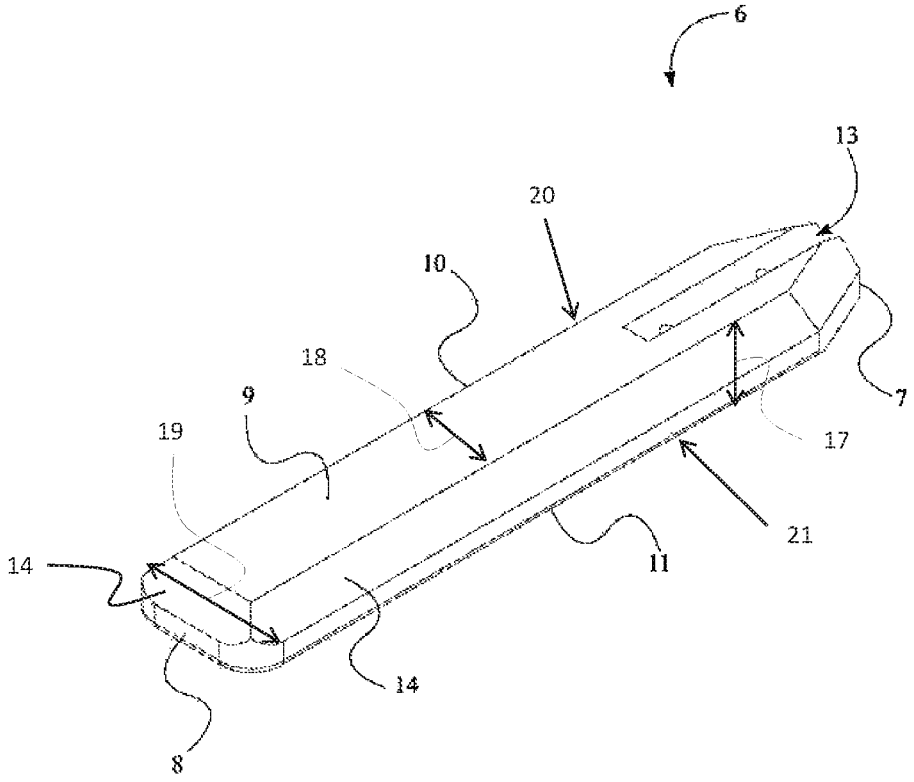
FIG. 5 is a perspective view of the blade portion.
Figure 6:
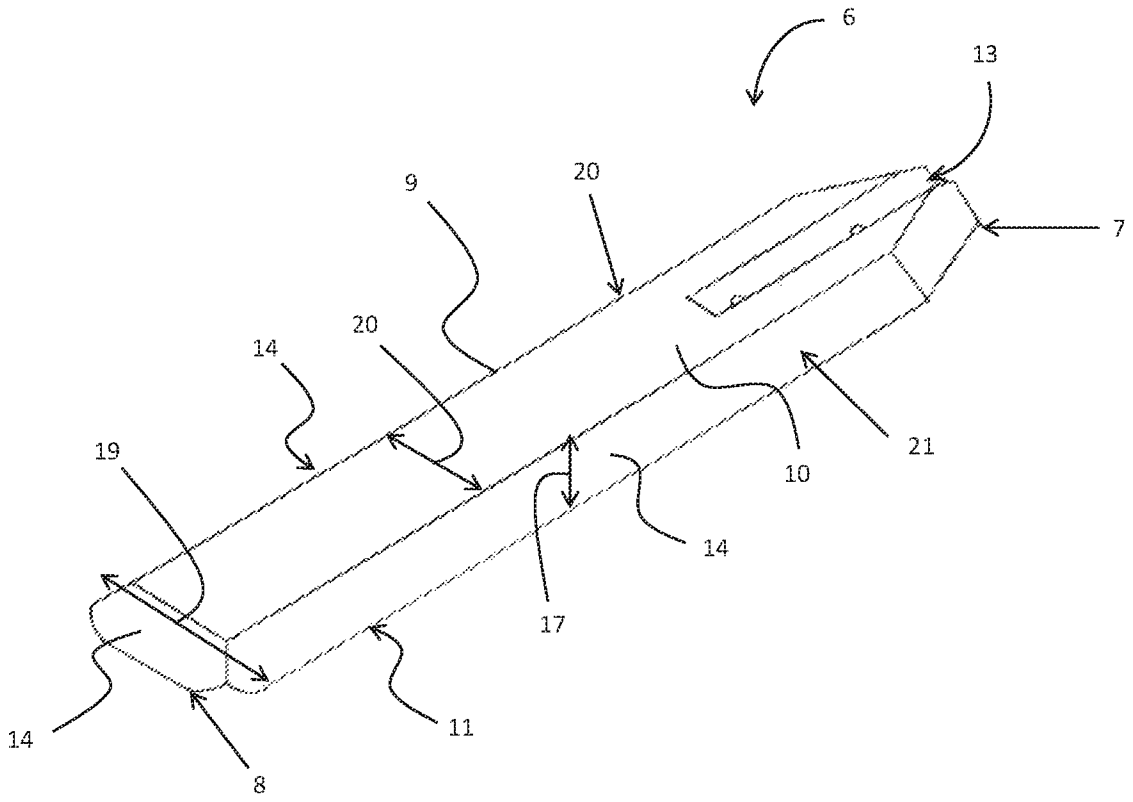
FIG. 6 is a perspective view of the blade portion.

Turning now to FIG. 5 in detail, as discussed earlier, the blade portion 6, which represents the club head, is vital in simulating a golf swing. Moreover, the shape of the blade portion 6 is important so that the present invention has aerodynamic features when the grass cutting motion is executed. To achieve the required shape, the blade portion 6 comprises a proximal end 7, a distal end 8, a first longitudinal side 20, a second longitudinal side 21, a blade body 9, a top edge 10, and a bottom edge 11. The blade body 9, which has an overall isosceles-trapezoidal shape, extends from the proximal end 7 to the distal end 8, and from the first longitudinal side 20 to the second longitudinal side 21. The isosceles-trapezoidal shape is a result of the differences between the widths of the top edge 10 and the bottom edge 11. The top edge 10 includes a top width 18, and the bottom edge 11 includes a bottom width 19. The bottom width 19 is greater than the top width 18, thereby creating a tapered edge 14 from the bottom edge 11 to the top edge 10. The tapered edge 14 will be discussed in greater detail below. The bottom and top widths 19, 18 span along a lateral axis of the blade body 9, between the first longitudinal side 20 and the second longitudinal side 21.

A distance between the proximal end 7 and the distal end 8 determines the length of the blade body 9. The blade body 9 is elongated, such that the length of the blade body 9 is greater than the bottom width 19, which, as discussed above, is in turn greater than the top width 18. Moreover, the blade body 9 extends along a vertical axis from the top edge 10 to the bottom edge 11, so that a height 17 of the blade body 9 is determined by a distance between the top edge 10 and the bottom edge 11. It is important for the aerodynamic features of the blade portion 6, as discussed above, for the height 17 of the blade body 9 to be relatively small, thereby ensuring that the blade body 9 can cut through both air and one or more leaves of grass with little resistance. In an embodiment, the height 17 of the blade body 9 measures between ⅛ inches and ½ inches; in an exemplary embodiment, the height 17 measures ¼ inches. As such, the height 17 is significantly smaller than a radius of a standard golf ball (which has a diameter of 1.68 inches and a radius of 0.84 inches), and significantly smaller than a height of a typical putter (which has a height of approximately 1 inch to effectively strike a standard golf ball). Accordingly, the training aid is not designed for, and is incapable of, effectively striking a golf ball, since a clean contact would not occur due to the relatively small height 17. Instead, the training aid is designed for practicing the motions of a golf swing, particularly the angle at which a golfer should strike a golf ball by concentrating on cutting the grass.

When considering the connection between the neck portion 5 and the blade portion 6, the proximal end 7 is connected adjacent to the neck portion 5 opposite the second end 4 of the club shaft 1. As mentioned before, the neck portion 5 can be welded or connected via the plurality of screws. As illustrated in FIG. 5, the present invention further comprises a receiving channel 13 that is used to position the neck portion 5 appropriately. The receiving channel 13 traverses into the blade body 9 and the proximal end 7 adjacent to the top edge 10, so that the neck portion 5 can be positioned into the receiving channel 13. Preferably, a diameter of the receiving channel 13 is equal to or marginally larger than a diameter of the neck portion 5, so that the neck portion 5 is firmly positioned within the receiving channel 13.

As discussed before, the present invention utilizes the grass cutting motion for practicing the golf swing. In particular, the present invention helps the user focus on striking the grass with the blade portion 6, so that when a golf club is used, the club head would meet the golf ball at an optimal contact point. Since the blade portion 6 strikes the grass during each swing, both on the forward-swing and the backward-swing, the blade portion 6 needs to be designed appropriately to traverse through grass. The blade portion 6 thereby provides a visual indicator of a successful swing when one or more leaves of grass either move or are removed (i.e., cut away) from the ground surface. To do so, the present invention further comprises one or more tapered edges 14 that are perimetrically distributed along the top edge 10, contributing to the isosceles-trapezoidal shape of the blade body 9. In combination with the relatively small height 17 of the blade body 9, the tapered edges 14 also help the blade portion 6 move through air and grass with minimum resistance due to the angle of the taper from the bottom edge 11 to the top edge 10. To allow the blade portion 6 to effectively travel through air and grass with little resistance, it is important that the angle of the taper is between approximately 300 and 60°, an in an exemplary embodiment, is 45° (as a point of reference, a typical putter includes a slight taper between the top and bottom edges, called a loft angle, which is usually between 2° and 10°, depending on the desired striking angle). The taper and the small height and surface area of the cutting surfaces (the first and second sides 20, 21) allow the training aid to cut through the air and grass to effectively train a golfer to improve his or her golf swing via the visual indicator provided by the cutting mechanism. Such training aid could not be effectively achieved using typical golf clubs due to the differences in shape, design, and intended purpose. On the other hand, the flat surface along the bottom edge 11 of the blade body 9 allows the blade portion 6 to smoothly strike a ground surface. An additional tapered edge 14 may be disposed at the distal end 8 of the blade portion 6, such that the bottom edge 11 has an associated length along the longitudinal axis of the blade portion 6 that is longer than an associated length of the top edge 10, also disposed along the longitudinal axis of the blade portion 6. The additional tapered edge 14 provides further aerodynamic advantages, allowing the blade portion 6 to easily cut through air and grass.

The present invention further comprises a gripping portion 15 that allows the user to maintain a firm hold on the present invention. The gripping portion 15, which is similar to a grip on a golf club, is preferably made of rubber or other comparable material. Moreover, the gripping portion 15 is positioned along the club shaft body 3 adjacent to the first end 2. The gripping portion 15 is sufficiently sized so that the user can hold the present invention at a preferred location.

When utilizing the present invention, the following process flow is generally followed. Initially, the user holds the present invention at the gripping portion 15. More specifically, a grip used when holding a golf club is used to hold the present invention at the gipping portion 15. The design of the blade portion 6 allows both left-handed users and right-handed users to utilize the present invention in the same manner, since the blade portion 6 includes the tapered edges 14 on both the first longitudinal side 20 and the second longitudinal side 21. In an initial, pre-swing orientation, the bottom edge 11 of the blade portion 6 rests on a ground surface, parallel to the ground surface.

When appropriately gripped, the user simulates a grass cutting motion with the present invention. In doing so, the user focuses on cutting the grass with the blade portion 6, such that the blade body 9 along the bottom edge 11 strikes the ground during each swing, and such that the blade body 9 along the tapered edges 14 cuts through the air and the grass during each swing, both on the forward-swing and the backward-swing, for each a left-handed and a right-handed golfer. Since the present invention trains the user to focus on cutting the grass during the swing, when a golf club is used with a golf ball, the user maintains focus on the grass beneath the golf ball. Thus, the club head of the golf club meets the golf ball at the optimal contact point. Moreover, the back and forth swinging of the present invention, as a result of the design of the blade portion 6, ensures that the user utilizes all of the muscles that are involved in a golf swing. In other words, the present invention helps the user practice the full range of motion related to a golf swing. In addition to training the muscles involved in a golf swing, the properties of the blade portion 6 ensure that the wrists of the user are correctly positioned during each swing. The continuous use of the present invention also helps improve club head speed. By utilizing the present invention, the user is provided with a simple but highly effective golf training aid.

Glossary of Claim Terms

Standard golf ball: a small, hard, spherical object used in the game of golf, having an associated diameter of no less than 1.68 inches.

Taper: becoming progressively smaller toward one end.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A golf training aid comprising:

a club shaft including a first end opposite a second end, with a club shaft body extending from the first end to the second end;

a neck portion fixedly coupled to the second end of the club shaft, the neck portion being coplanar with the club shaft and including a curved terminal portion; and an elongated blade portion having a proximal end opposite a distal end, the curved terminal portion of the neck portion secured to the proximal end of the blade portion, the blade portion having a trapezoidal shape defined by a top surface, a bottom surface, a first longitudinal side, and a second longitudinal side, the blade portion:

having the top surface opposite the bottom surface, each of the top and bottom surfaces having an associated width parallel to a lateral axis of the blade portion and perpendicular to a longitudinal axis of the blade portion, the width of the bottom surface being greater than the width of the top surface;

having a length from the proximal end to the distal end, the length being greater than the width of the bottom surface, such that the blade portion is elongated and extends away from the club shaft;

including a receiving channel formed within the blade portion at the proximal end of the blade portion, the receiving channel disposed within the top surface and extending toward the bottom surface, with the neck portion fixedly secured within the receiving channel, such that the proximal end of the blade portion forms an obtuse angle with respect to the club shaft;

having the first longitudinal side opposite the second longitudinal side, the first and second longitudinal sides spanning from the proximal end of the blade portion to the distal end of the blade portion along the longitudinal axis of the blade portion, each of the first and second longitudinal sides being disposed between the bottom and top surface, such that the first longitudinal side is a first tapered edge and the second longitudinal side is a second tapered edge, each of the first and second tapered edges having a taper angle of between 30° and 60° with respect to the bottom surface, each taper angle spanning from the bottom surface to the top surface; and having a height disposed between the top and bottom surfaces and parallel to a vertical axis of the blade portion, the height being between ⅛ inches and ½ inches;

whereby the blade portion creates a visual indicator of a successful swing when one of the first and second tapered edges cuts though one or more leaves of grass, the visual indicator being a change in position of the one or more leaves of grass.

2. The golf training aid of claim 1, wherein:

each of the top and bottom surfaces includes an associated length parallel to the longitudinal axis of the blade portion and perpendicular to the lateral axis of the blade portion, the length of the bottom surface being greater than the length of the top surface, such that there is a third tapered edge disposed at the distal end of the blade portion, the third tapered edge spanning along the lateral axis of the blade portion and disposed between the bottom and top surfaces.

3. The golf training aid of claim 1, further comprising:

a gripping portion positioned along the club shaft body adjacent to the first end.

4. A method of training to improve a golf swing, comprising the steps of:

gripping a first end of a club shaft of a golf training aid, the golf training aid including:

a second end of the club shaft that is opposite the first end, the second end coupled to a neck portion;

a trapezoidal-shaped blade portion defined by a top surface, a bottom surface, a first longitudinal side, and a second longitudinal side, the blade portion including a proximal end opposite a distal end and a length extending from the proximal end to the distal end, the length being greater than a width of the bottom surface, such that the blade portion is elongated, with a receiving channel formed within the blade portion at the proximal end of the blade portion, the receiving channel disposed within the top surface and extending toward the bottom surface, with the neck portion secured within the receiving channel, such that the blade portion extends away from the club shaft, and such that the proximal end of the blade portion forms an obtuse angle with respect to the club shaft;

each of the top and bottom surfaces having an associated width parallel to a lateral axis of the blade portion and perpendicular to a longitudinal axis of the blade portion, the width of the bottom surface being greater than the width of the top surface;

a first longitudinal side opposite a second longitudinal side, the first and second longitudinal sides spanning from the proximal end of the blade portion to the distal end of the blade portion along the longitudinal axis of the blade portion, each of the first and second longitudinal sides being disposed between the bottom and top surface, such that the first longitudinal side is a first tapered edge and the second longitudinal side is a second tapered edge, each of the first and second tapered edges having a taper angle of between 30° and 60° with respect to the bottom surface, each taper angle spanning from the bottom surface to the top surface;

the blade portion having a height disposed between the top and bottom surfaces and parallel to a vertical axis of the blade portion, the height being between ⅛ inches and ½ inches; and swinging the golf training aid such that the first tapered edge traverses through one or more leaves of grass.

5. The method of claim 4, further comprising the step of:

swinging the golf training aid such that the second tapered edge of the blade portion cuts through one or more leaves of grass during a backswing.

6. The method of claim 4, further comprising the step of:

striking a ground surface with the bottom surface of the blade portion at a low point of the golf swing.

7. The method of claim 4, further comprising the step of:

resting the bottom surface of the blade portion on the ground surface in a pre-swing configuration, such that the bottom surface is parallel with a plane defined by the ground surface.

* * * * *